US010907776B1

(12) United States Patent
Haddad

(10) Patent No.: US 10,907,776 B1
(45) Date of Patent: Feb. 2, 2021

(54) FLEXIBLE, CUSTOMIZABLE, AND WEARABLE FLASHLIGHT

(71) Applicant: MIW Tech International LLC, Ellicott City, MD (US)

(72) Inventor: Robert Yousef Haddad, Amman (JO)

(73) Assignee: MIW Tech International LLC, Ellicott City, MD (US)

( * ) Notice: Subject to any disclaimer, the term of this patent is extended or adjusted under 35 U.S.C. 154(b) by 0 days.

(21) Appl. No.: 16/919,089

(22) Filed: Jul. 1, 2020

(51) Int. Cl.

| | |
|---|---|
| ***F21L 4/02*** | (2006.01) |
| ***F21L 4/04*** | (2006.01) |
| ***F21V 21/08*** | (2006.01) |
| ***F21V 21/096*** | (2006.01) |
| ***F21V 21/32*** | (2006.01) |
| ***F21V 23/04*** | (2006.01) |
| ***F21S 4/22*** | (2016.01) |
| *F21Y 113/10* | (2016.01) |
| *F21Y 115/10* | (2016.01) |
| *F21V 21/084* | (2006.01) |

(52) U.S. Cl.
CPC ..... *F21L 4/027* (2013.01); *F21L 4/04* (2013.01); *F21S 4/22* (2016.01); *F21V 21/0816* (2013.01); *F21V 21/0965* (2013.01); *F21V 21/32* (2013.01); *F21V 21/084* (2013.01); *F21V 23/0414* (2013.01); *F21V 23/0435* (2013.01); *F21Y 2113/10* (2016.08); *F21Y 2115/10* (2016.08)

(58) Field of Classification Search
CPC ..... F21V 21/0816
See application file for complete search history.

(56) References Cited

U.S. PATENT DOCUMENTS

| | | | | |
|---|---|---|---|---|
| 5,944,407 | A * | 8/1999 | Lynch | F21L 4/06 362/184 |
| 9,464,770 | B2 * | 10/2016 | Morgan | F21V 23/001 |
| 10,182,556 | B1 * | 1/2019 | Osher | A01K 27/003 |
| 10,753,553 | B2 * | 8/2020 | Gross | F21V 23/0471 |
| 2005/0063179 | A1 * | 3/2005 | Niemann | F21L 4/085 362/184 |
| 2006/0139927 | A1 * | 6/2006 | Kovacik | F21L 4/08 362/260 |
| 2011/0299275 | A1 * | 12/2011 | Fuchs | F21L 4/04 362/190 |
| 2018/0320839 | A1 * | 11/2018 | Briscoe | F21V 21/096 |

* cited by examiner

*Primary Examiner* — Alan B Cariaso
(74) *Attorney, Agent, or Firm* — Rahman LLC

(57) ABSTRACT

A flashlight includes a longitudinal elongated middle portion having an array of light emitting diodes (LEDs) arranged for emitting light from a front side of the middle portion, the middle portion being flexible, wherein the flexibility enables bending of the middle portion in a plane through a longitudinal axis of the flashlight; a male hinged clasp configured on a first end of the middle portion, the male hinged clasp having a hinged male interlocking piece for rotary movement about a corresponding hinge axis perpendicular to a plane of bending of the middle portion; and a female hinged clasp configured on a second end of the middle portion, the female hinged clasp having a hinged female interlocking piece for rotary movement about a corresponding hinge axis perpendicular to the plane of bending of the middle portion, the hinged female interlocking piece being configured to interlock with the hinged male interlocking piece.

20 Claims, 10 Drawing Sheets

FLEXIBLE, CUSTOMIZABLE, AND WEARABLE FLASHLIGHT

BACKGROUND

Technical Field

The embodiments herein generally relate to lighting systems, and more particularly to a flexible, customizable, and wearable flashlight that is modular, and a customizable flashlight system comprising one or more of the customizable flashlights.

Description of the Related Art

Different types of lights are used as flashlights and head lamps. Policemen, firemen, public works employees, or anyone working in areas where there may be a danger to themselves often wear flashlights on the head or arm(s) to draw others' attention to themselves to avert any danger. Flashlights are also used for decorative purposes, for outdoor sporting and leisure activities. However, each application typically requires a different type of flashlight increasing the variety and limiting the utility of each type of flashlight to the application for which it is designed, which has cost implications.

SUMMARY

In view of the foregoing, an embodiment herein provides a flashlight having a longitudinal shaped (e.g., elongated) middle portion, a male hinged clasp configured on a first end of the middle portion and a female hinged clasp configured on a second end of the middle portion. The middle portion includes an array of light-emitting diodes (LEDs) arranged for emitting light from a front side of the middle portion. The middle portion is flexible that enables its bending in a plane through a longitudinal axis of the flashlight. For example, the middle portion may be twisted to allow the flashlight to have an overall twisted configuration.

The male hinged clasp and the female hinged clasp respectively include a hinged male interlocking piece and a hinged female interlocking piece. The hinged male and female interlocking pieces are configured for rotary movement about respective hinge axes that are substantially perpendicular to the plane of bending of the middle portion. The hinged female interlocking piece is configured to interlock with the hinged male interlocking piece.

In a first mode of application, the first end and the second end are brought together such that the male hinged clasp and the female hinged clasp are in a substantially parallel disposition with the hinged male interlocking piece and the hinged female interlocking piece rotated to face each other and interlocked for use of the flashlight as a handheld flashlight, or as a lantern when placed on a surface.

In a second mode of application, the middle portion is bent to a substantially semi-circular shape and the hinged male interlocking piece and the hinged female interlocking piece are respectively interlocked with a female end and a male end of an adjustable strap for wearing on a user.

In a third mode of application, the middle portion is bent to a substantially circular shape and the hinged male interlocking piece and the hinged female interlocking piece are interlocked to each other, without rotation, for use as a mood light by placing on a surface with the interlocked male hinged clasp and the female hinged clasp resting on the surface.

The middle portion may include a front cover, a back cover, a set of first side covers comprising a front first side cover and a back first side cover, a set of second side covers comprising a front second side cover and a back second side cover. The covers may be made of silicon rubber and coupled to respective other cover and the male and female hinged clasps by one or more of an interlocking joint, adhesive and ultrasonic welding to make a waterproof assembly that houses various functional parts and modules.

The flashlight may further include one or more capacitive touch pads located on a flexible transparent board that is attached to the front cover. The flexible transparent board attached with the capacitive pads allows transmission of the emitted light from the array of LEDs, and also allows a user to control intensity of the emitted light by switching individual LEDs on and off by sliding a finger over the flexible transparent board.

The flashlight may further include a pair of magnet components located at the first end and the second end of the middle portion within the set of first side covers and the set of second side covers. The magnet components may be configured such that the male hinged clasp and the female hinged clasp, when interlocked, remain coupled to each other under attractive force of the magnet components. The magnet components may additionally provide magnetic force to fix the flashlight on a vertical metallic surface.

The array of LEDs may include red, green, blue +white (RGBW) LEDs. The flashlight may include a controller to control the RGBW LEDs to operate the flashlight in different lighting modes. The controller by controlling the RGBW LEDs may generate different lighting modes, which may include activating one or more selected sets of RGBW LEDs to emit light of different colors, activating one or more selected sets of RGBW LEDs at full intensity or partial intensity such as medium intensity or low intensity. The flashlight may include a storage operatively coupled to the controller. The storage may be configured to store different lighting modes, which may include pre-programmed lighting modes and programmed lighting modes.

The flashlight may include a Bluetooth® communication module, which may be configured to operatively couple the flashlight to a mobile computing device of a user. The coupled mobile computing device may have a software application (app) that may allow the user to program the flashlight for operation in the different programmed lighting modes. The app may be further configured to operatively couple to and operate one or more flashlight in unison.

The flashlight may include a set of buttons including one or more of a mode/sleep button and a color button. The mode/sleep button may toggle (i) between different pre-programmed and programmed lighting modes, and (ii) between a sleep mode and active mode of operation, and the color button may toggle through different colors emitted by the LEDs in the selected lighting mode, wherein the color button is selectively engaged to indicate a power level of the flashlight. In an example, when the mode/sleep button is pressed for three seconds, the flashlight enters into a sleep mode (e.g., low power mode) and when the mode/sleep button is pressed again for three seconds, then the flashlight enters into an active mode (i.e., wakes from the sleep mode for normal operation). The flashlight may include a power module for powering the LEDs, which may include one or more rechargeable batteries and a charging port. The flashlight may also include one or more of a Global System for Mobile (GSM) communications module, a Global Positioning System (GPS) module and an Electronic Compass (EC) module.

Another embodiment provides a flashlight system having one or more flashlights, each of the flashlights includes a longitudinal shaped (i.e., elongated) middle portion, a male hinged clasp configured on a first end of the middle portion and a female hinged clasp configured on a second end of the middle portion. The middle portion includes an array of LEDs arranged for emitting light from a front side of the middle portion. The middle portion is flexible that enables its bending in a plane through a longitudinal axis of the flashlight.

The male hinged clasp and the female hinged clasp respectively include a hinged male interlocking piece and a hinged female interlocking piece. The hinged male and female interlocking pieces are configured for rotary movement about respective hinge axes that are perpendicular to the plane of bending of the middle portion. The hinged female interlocking piece is configured to interlock with the hinged male interlocking piece.

The hinged male and female interlocking pieces allow the flashlights to be customized in different shapes and couple operation of the one or more flashlights together. Each of the flashlights comprises a Bluetooth® communication module, the Bluetooth® communication module being configured to operatively couple to a mobile device of a user, the mobile computing device operating or running an app to allow the user to program the one or more flashlight for operation in different programmed lighting modes, and wherein the app is further configured to operatively couple to and operate one or more flashlight in unison.

The different shapes of the one or more flashlight may include a circular shape created by bending the middle portion to a circular shape and interlocking the hinged male interlocking piece and the hinged female interlocking piece to each other without rotation of the hinged male and female interlocking pieces. The circular shaped flashlight may be used as a mood light by placing on a surface with the interlocked male hinged clasp and the female hinged clasp resting on the surface Another shape is a lantern shape created by bringing the first end and the second end together in parallel disposition, rotating the hinged male and female interlocking pieces and interlocking the hinged male and female interlocking pieces to each other, for use of the flashlight as a handheld flashlight, or as a lantern when placed on a surface. Yet another shape is a semi-circular shape created by bending the middle portion and coupling the hinged female and male interlocking pieces respectively with a female end and a male end of an adjustable strap for hanging the one or more flashlight or for wearing on head or arm of one or more users.

The array of LEDs may include RGBW LEDs, and which are controlled by a controller in the flashlight to operate the flashlight in the different lighting modes, which may include activating one or more selected sets of RGBW LEDs to emit light of different colors, activating one or more selected sets of RGBW LEDs at full intensity or medium intensity or low intensity. Each of the one or more flashlight can be independent in respect of its power requirement by having a power module for powering the LEDs. The power module can have one or more rechargeable batteries and a charging port.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1A:
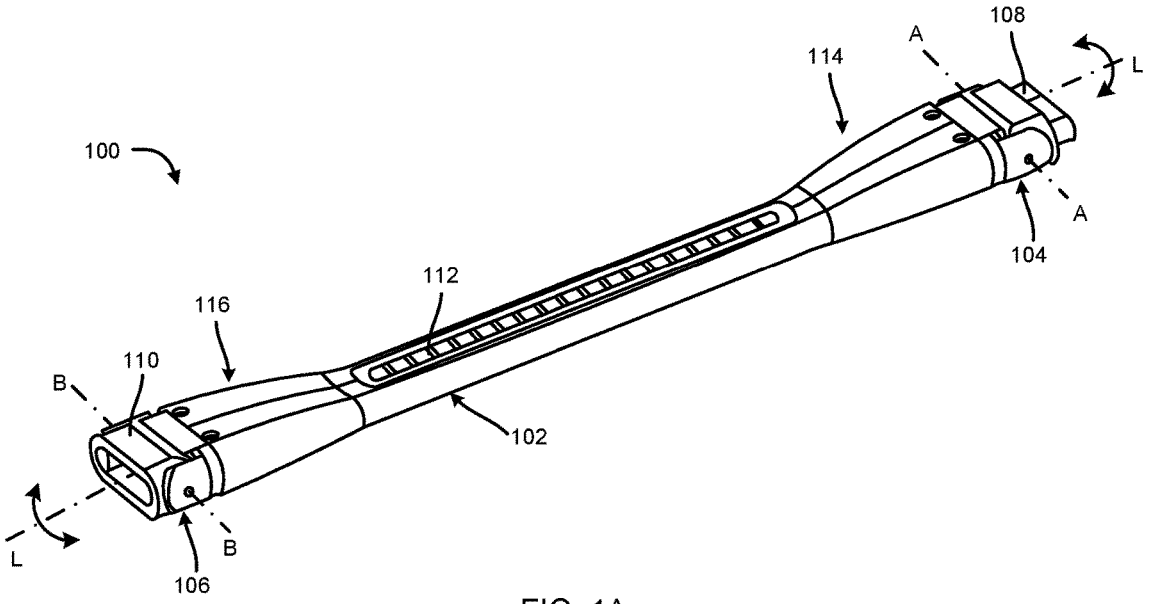
FIG. 1A is an exemplary isometric view of a flashlight showing a middle portion, a male hinged clasp, and a female hinged clasp, according to the embodiments herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

It will be understood that when an element or layer is referred to as being "on", "connected to", or "coupled to" another element or layer, it may be directly on, directly connected to, or directly coupled to the other element or layer, or intervening elements or layers may be present. In contrast, when an element or layer is referred to as being "directly on", "directly connected to", or "directly coupled to" another element or layer, there are no intervening elements or layers present. It will be understood that for the purposes of this disclosure, "at least one of X, Y, and Z" may be construed as X only, Y only, Z only, or any combination of two or more items X, Y, and Z (e.g., XYZ, XYY, XZ, ZY, YZ, XX, YY, ZZ, etc.).

The embodiments herein provide a modular, customizable and flexible flashlight, and a flashlight system containing one or more of a modular, customizable, and flexible flashlight. The flexible flashlight can be bent, and its two ends interlocked, with two ends of an adjustable strap or among themselves, to customize the flashlight in different shapes for use in different modes. A Bluetooth® communication module provided in the flashlight allows the flashlight to be operatively coupled to a mobile computing device of a user. An app in the coupled mobile computing device may allow the user to program the flashlight for operation in different programmed lighting modes. The Bluetooth® communication module of the flashlight enables the coupling of a number of flashlights to a user's mobile computing device to create a flashlight system. The flashlights thus coupled to the mobile computing device can be operated in unison in different programmed and pre-programmed lighting modes. Referring now to the drawings, and more particularly to FIGS. 1A through 8E, where similar reference characters denote corresponding features consistently throughout, there are shown exemplary embodiments. In the drawings, the size and relative sizes of components, layers, and regions, etc. may be exaggerated for clarity.

Figure 1B:
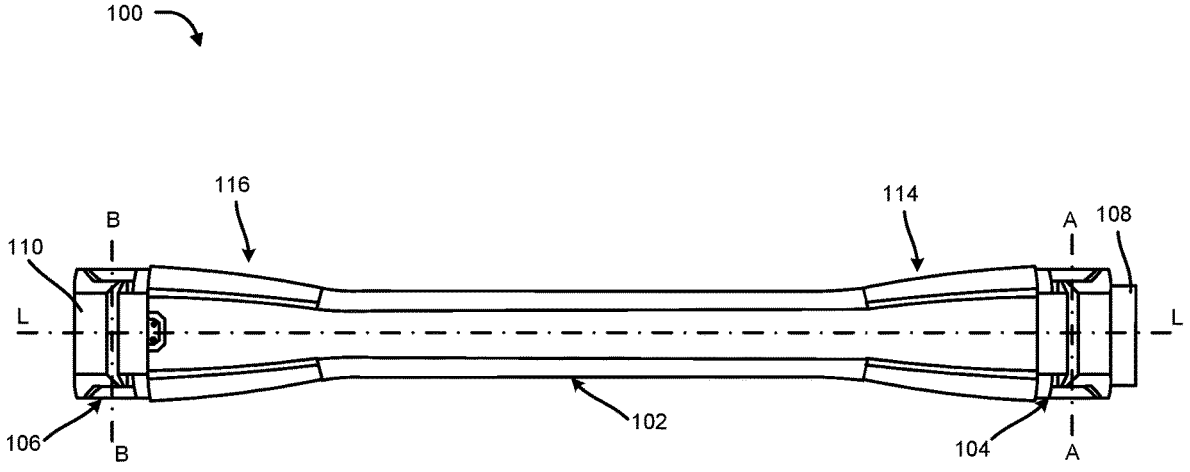
FIG. 1B is an exemplary bottom view of the flashlight of FIG. 1A, according to the embodiments herein.

Referring to FIGS. 1A and 1B, where an isometric and bottom views respectively of the modular, flexible and customizable flashlight are shown, the flashlight 100 can include a longitudinal shaped middle portion 102 that includes a transparent board 112 on a front side of the middle portion 102 along its length for emitting light. The middle portion 102 is flexible, such that the flashlight 100 can be bent in a plane that passes through a longitudinal axis L-L (a vertical plane in the illustration of FIG. 1A) of the flashlight 100. The middle portion 102 may be formed of a suitable material that permits bending/flexibility thereof. The transparent board 112 can be flexible to enable its bending as the middle portion 102 is bent, therefore also referred to as flexible transparent board 112. The flashlight 100 further includes a male hinged clasp 104 configured on a first end 114 of the middle portion 102. The male hinged clasp 104 includes a hinged male interlocking piece 108, which can rotate about a hinge axis A-A that is perpendicular to the plane of bending of the middle portion 102, as shown by an arrow in FIG. 1A.

The flashlight 100 further includes a female hinged clasp 106 configured on a second end 116 of the middle portion 102. The female hinged clasp 106 includes a hinged female interlocking piece 110, which can rotate about a hinge axis B-B that is perpendicular to the plane of bending of the middle portion 102, thereby enabling the hinged female interlocking piece 110 to move, as shown by an arrow in FIG. 1A. The hinged female interlocking piece 110 is configured to engage and interlock with the hinged male interlocking piece 108 when the hinged male interlocking piece 108 and the hinged female interlocking piece 110 are brought close to each other by bending of the middle portion 102. In an example, the male hinged clasp 104 and the female hinged clasp 106 may each comprise their own magnet components to facilitate magnetic linking.

Figure 2:
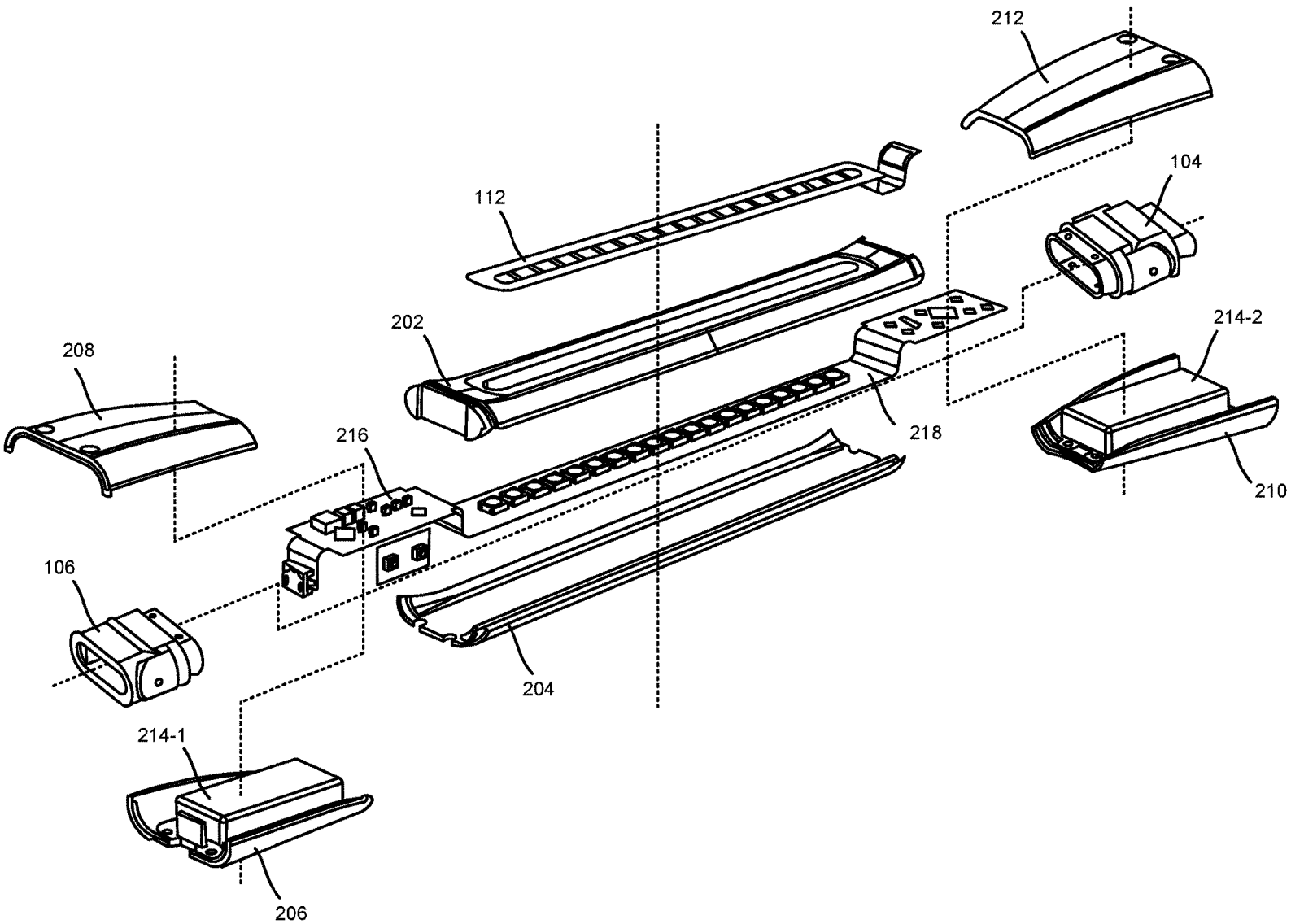
FIG. 2 is an exemplary exploded view of the flashlight of FIG. 1A showing the arrangement of different functional parts and modules within a set of covers, and the male and female hinged clasps, according to the embodiments herein.

FIG. 2, with reference to FIGS. 1A and 1B, shows an exploded view of the flashlight 100, showing a front cover 202, a back cover 204, a set of first side covers comprising a front first side cover 212 and a back first side cover 210, a set of second side covers comprising a front second side cover 208 and a back second side cover 206. The covers 202, 204, 206, 208, 210, and 212 can be made of a flexible material, such as but not limited to silicon rubber, by injection molding process. The front cover 202 and the back cover 204 can have an interlocking fit between them, as shown in the sectional view of the middle portion 102 of FIG. 4. Besides the interlocking joint between the front cover 202 and the back cover 204, the covers 202, 204, 206, 208, 210, and 212 can be glued together using a waterproof adhesive to provide waterproof joints.

In a non-limiting example, the male hinged clasp 104 and the female hinged clasp 106 can be made of hard plastic material and can be fixed to the first end 114 and the second end 116 (refer FIGS. 1A and 1B) of the assembled middle portion 102 by an adhesive to seal them with the silicon rubber covers 210 and 212 on the first end 114, and with covers 206 and 208 on the second end 116. Hardware, such as hexagonal screws or other suitable connectors may also be used to hold the components together. Additionally, ultrasonic sealing can also be performed to make the overall assembly waterproof. Finally, a layer of neoprene or other similar material can be attached to the underside of the flashlight 100 using an adhesive. This may aid in securely grasping the flashlight 100 by a user. Moreover, this may also add comfort for when the user is wearing the flashlight 100 on his/her head and the neoprene layer may also be configured with holes or some other mechanism to provide breathability for the skin of the user.

The flexible transparent board 112 is fixed to the front cover 202, and a flexible board 218 that accommodates an array of LEDs below the flexible transparent board 112. The LEDs are fixed to a flexible board 218 arranged below the front cover 202. The flexible transparent board 112 can be attached with one or more capacitive pads that can enable a user to control the intensity of the emitted light by switching individual LEDs on and off by sliding a finger over the flexible transparent board 112.

The array of LEDs on the flexible board 218 may include RGBW LEDs, and the RGBW LEDs may be controlled to operate the flashlight 100 in different lighting modes. For example, the array of LEDs may display purely white light and/or 256 colors at varying intensities as programmed and/or controlled by a user. Controlling the RGBW LEDs may generate different lighting modes, which may include activating one or more selected sets of RGBW LEDs to emit light of different colors, activating one or more selected sets of RGBW LEDs at full intensity or medium intensity or low intensity. Additionally, other modes of use may include a S.O.S. emergency mode (i.e., to provide a visual alert, etc.), party mode (i.e., strobe light effect, etc.), sweeping light mode (e.g., moving spotlight, etc.), and a navigation mode (i.e., when the user or platform is moving or navigational positioning is desired, etc.)

A rigid board 216 is provided between the set of second side covers 206 and 208. The rigid board 216 can accommodate a microprocessor (not shown) to work as a controller to control operation of the LEDs in accordance with pre-programmed and programmed lighting modes, a storage to store the lighting modes, the Bluetooth® communication module. The rigid board 216 can also include a GSM Module, a GPS module, an EC module, a 9-Axis Inertial Measurement Unit, and charging module including rechargeable batteries. In an exemplary implementation a Cortex-MO™ MCU (available from Arm Limited, Calif., USA) may be provided to work as the controller and storage, which is embedded with a nRF52840™ module (available from Nordic® Semiconductor, Trondheim, Norway) to provide Bluetooth® Low Energy (BLE) to the flashlight 100.

FIG. 2 also shows magnet components 214-1, 214-2 (collectively and individually referred to as magnet component(s) 214) located between the set of first side covers 212, 210, and the set of second side covers 208, 206; i.e., at the first end 114 and the second end 116 of the middle portion 102. The magnet components 214 may be configured such that the male hinged clasp 104 and the female hinged clasp 106, when interlocked, remain coupled to each other under attractive force of the magnet components 214. The magnet components 214 can additionally provide magnetic force to fix the flashlight 100 on a metallic surface.

Figure 3A:
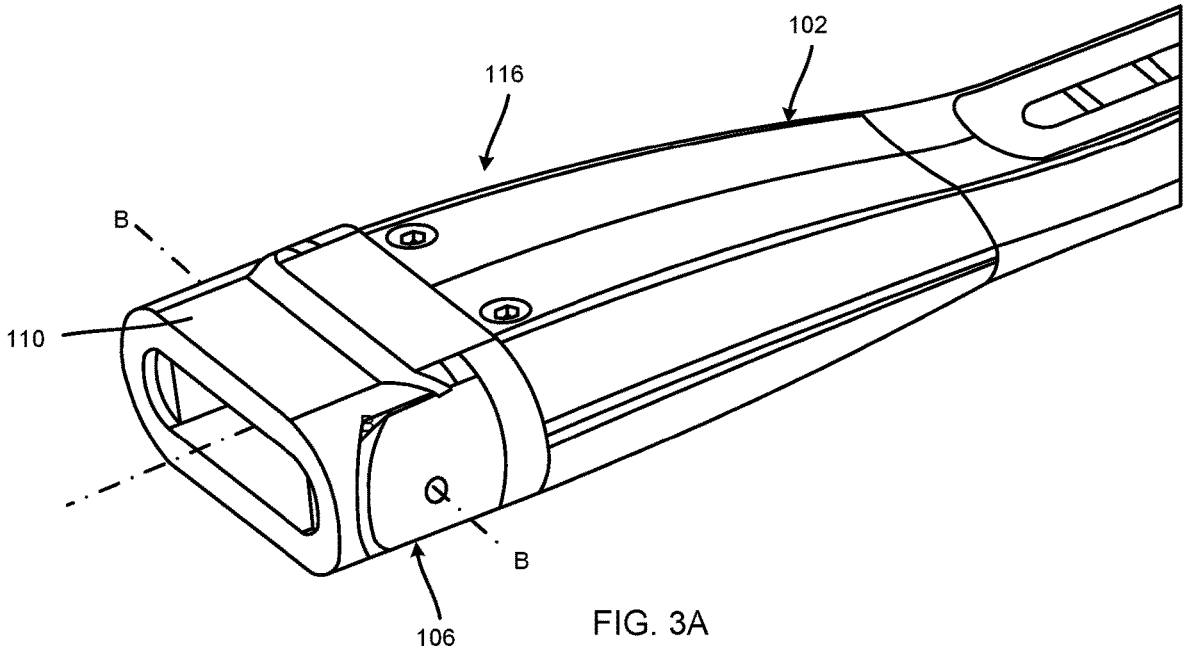
FIG. 3A is an exemplary top perspective view of the second side of the middle portion of the flashlight showing details of the female hinged clasp, according to the embodiments herein.
Figure 3B:
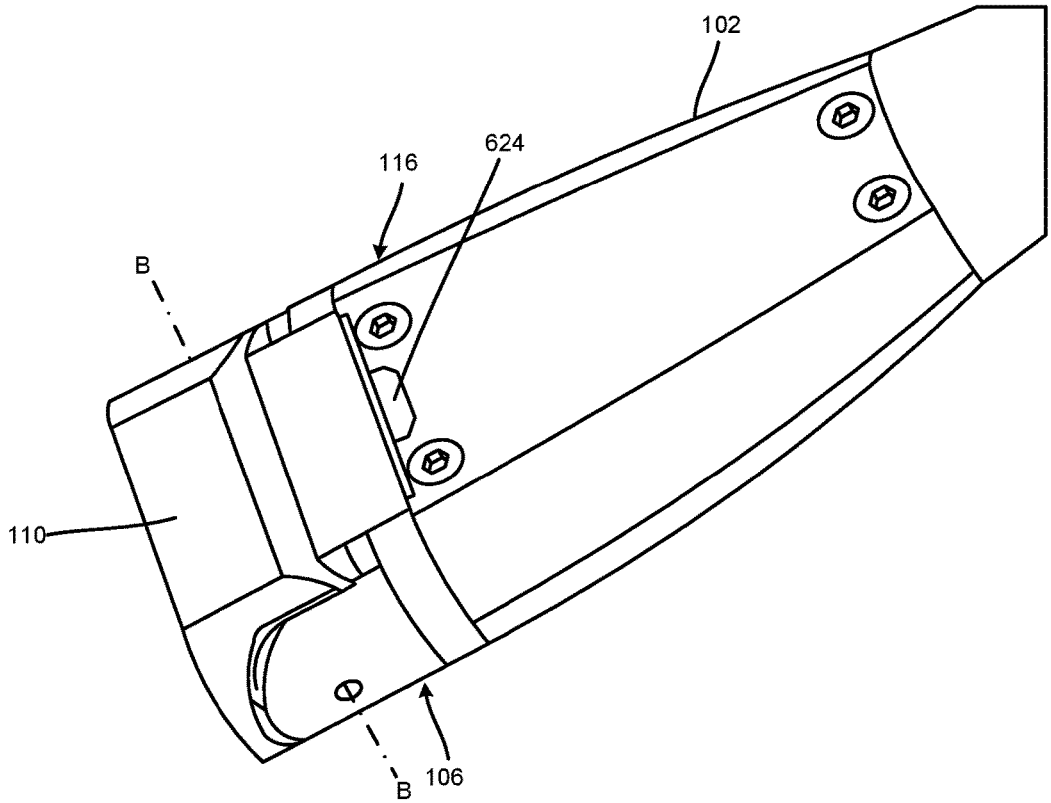
FIG. 3B is an exemplary bottom perspective view of the second side of the middle portion of the flashlight showing details of the female hinged clasp, according to the embodiments herein.
Figure 4:
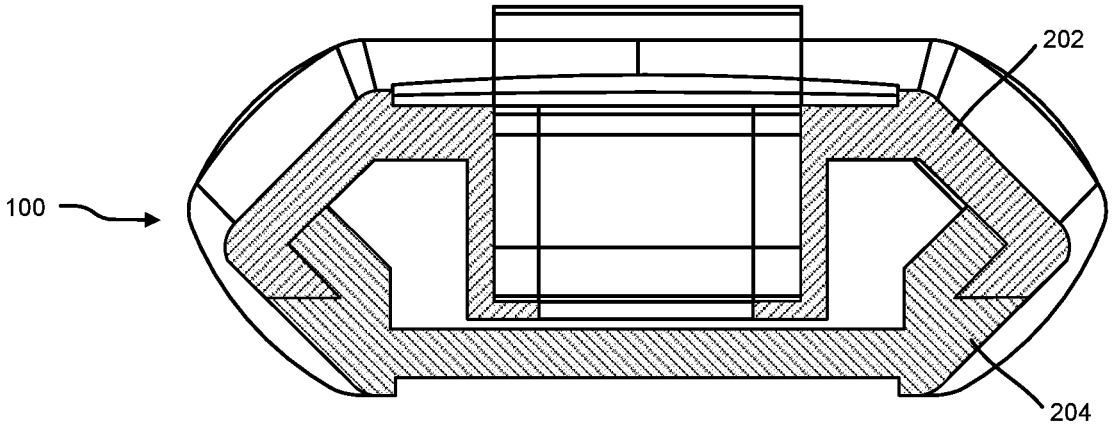
FIG. 4 is an exemplary sectional view of the middle portion of the flashlight showing the interlocking front and back covers, according to the embodiments herein.

FIGS. 3A and 3B, with reference to FIGS. 1A through 2, show a magnified top and bottom perspective views of the second side 116 of the middle portion 102 of the flashlight 100 showing details of the female hinged clasp 106, that has the hinged female interlocking piece 110 hinged about the hinge axis B-B for rotation. Also shown in FIG. 3B is a charging port 624 that can be connected to an external power source for charging the rechargeable batteries provided within the flashlight 100. In an exemplary implementation the rechargeable batteries can be two lithium ion batteries, which can power the array of LEDs for at least 16 hours at full intensity. In an example, the charging port can be a USB-C port and can be connected to the external power source by a USB charging cable.

Figure 5:
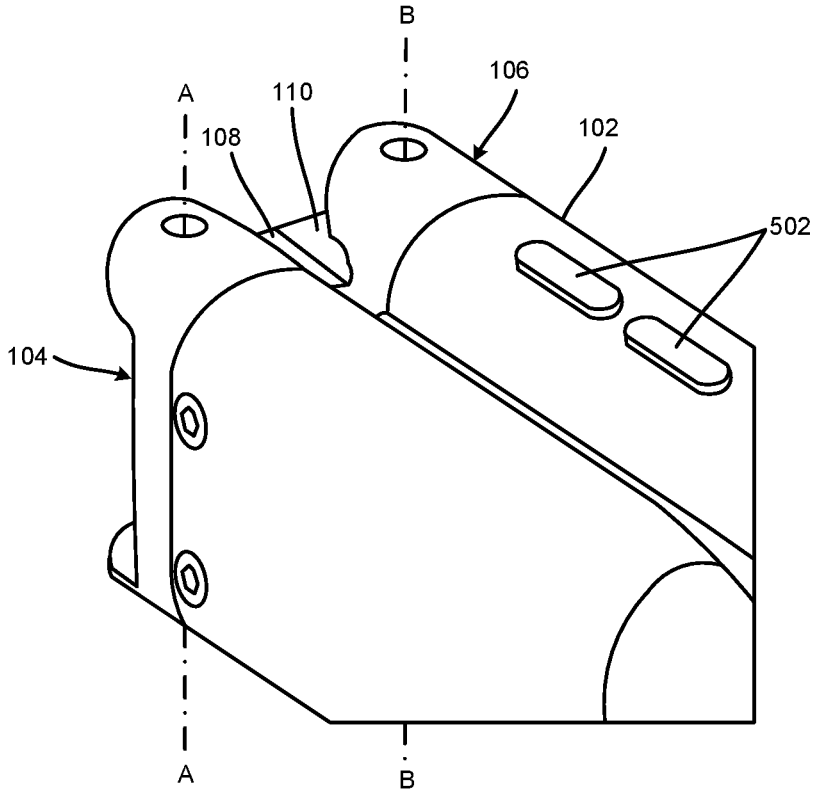
FIG. 5 is an exemplary partial perspective view of the flashlight in a handheld flashlight or a lantern mode with the male and female hinged clasps in parallel disposition and the corresponding hinged male and female interlocking pieces interlocked, according to the embodiments herein.

FIG. 5, with reference to FIGS. 1A through 4, shows a perspective view of the flashlight 100 in a handheld flashlight or a lantern mode. The flashlight 100 can be customized to handheld flashlight/lantern mode by bending the middle portion 102 to bring the first end 114 and the second end 116 together in a parallel disposition, rotating the hinged male interlocking piece 108 and the hinged female interlocking piece 110 about respective hinge axis A-A and B-B so that they face each other, and interlocking them to each other.

Also shown in FIG. 5 are a set of buttons 502, which can include a mode/sleep button and a color button. The mode/sleep button may toggle (i) between the different pre-programmed and programmed lighting modes, and (ii) between a sleep mode and active mode of operation, and the color button may toggle through different colors emitted by the LEDs in the selected lighting mode. In an example, when the mode/sleep button is pressed for three seconds, the flashlight 100 enters into a sleep mode (e.g., low power mode) and when the mode/sleep button is pressed again for three seconds, then the flashlight 100 enters into an active mode (i.e., wakes from the sleep mode for normal operation).

Figure 6:
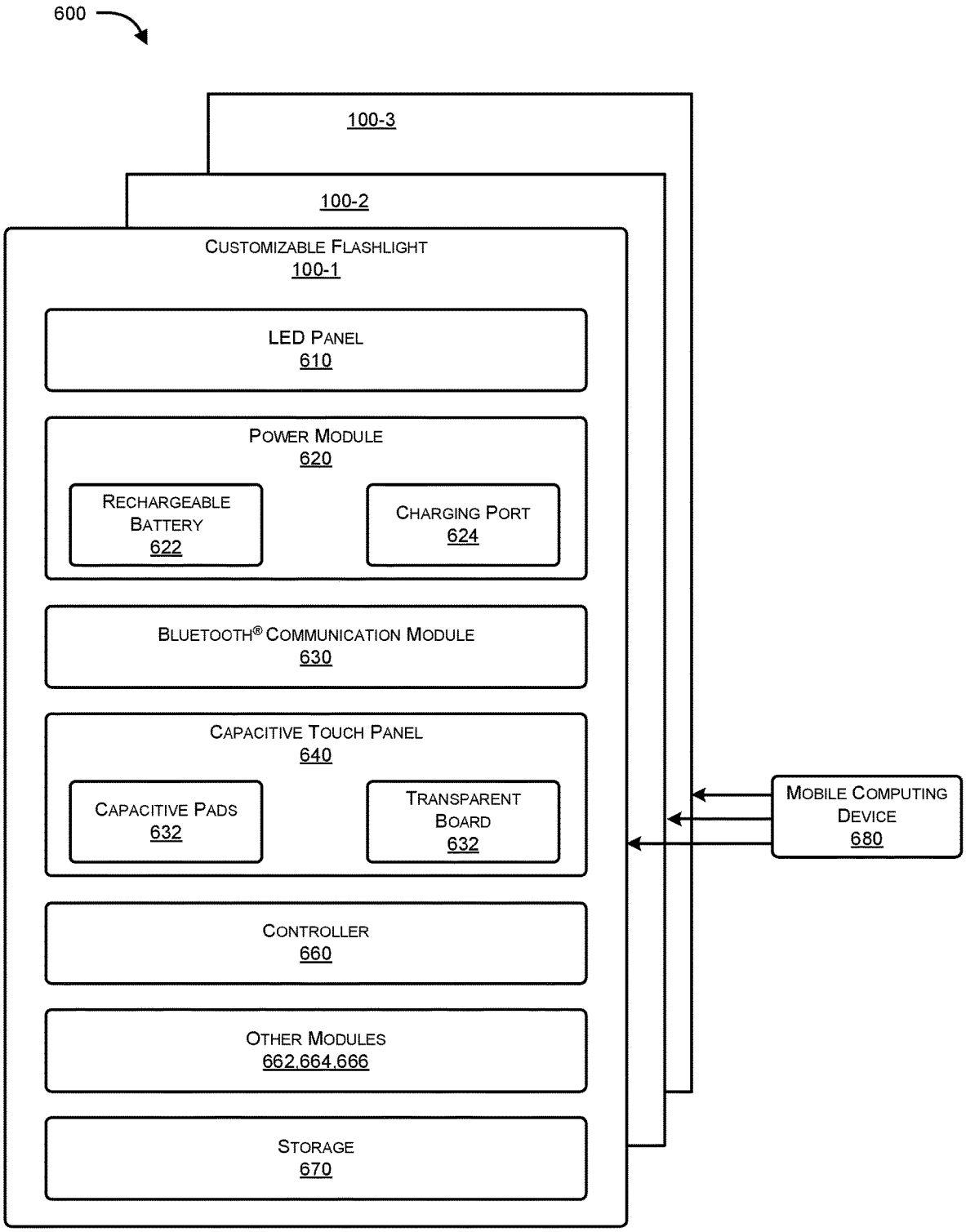
FIG. 6 is an exemplary system diagram showing different constituent parts and modules of the flashlight and operative coupling of a number of flashlights to a mobile computing device for operation in unison, according to the embodiments herein.

FIG. 6, with reference to FIGS. 1A through 5, is a system diagram for a flashlight system 600. The flashlight system 600 can include one or more flashlights, such as flashlights 100-1, 100-2, 100-3 . . . (collectively and individually referred to as flashlight(s) 100), and as described in FIGS, 1A through 5. Each of the one or more flashlights 100 can comprise a LED panel 610 comprising an array of RGBW LEDs arranged on a flexible board, such as flexible board 218 shown in FIG. 2; a charging port 624; and a power module 620 comprising rechargeable batteries 622, such that the rechargeable batteries 622 can be accommodated on the rigid board 216.

The flashlights 100 further include capacitive touch panel 640 comprising a flexible transparent board, such as flexible transparent board 112 shown in FIGS. 1 and 2, and capacitive pads 632 fixed to the flexible transparent board 112. Providing the capacitive pads 632 on the flexible transparent board 112 enable a user to control the intensity of the emitted light by switching individual LEDs on and off by sliding a finger over the flexible transparent board 112, for example.

The flashlights 100 can further include a controller 660, a Bluetooth® communication module 630 and storage 670. The controller 660 can be a microprocessor or microcomputer to control operation of the LEDs in accordance with pre-programmed and programmed lighting modes stored in the storage 670. In an exemplary implementation a Cortex-MO™ MCU (available from Arm Limited, Calif., USA) may be provided to work as the controller 660 and storage 670, which is embedded with a nRF52840™ module (available from Nordic® Semiconductor, Trondheim, Norway) to work as the Bluetooth® communication module 630. The flashlight 100 can also include a GSM Module 662, a GPS Module 664, a Compass Module 666, and a 9-Axis Inertial Measurement Unit, among other suitable modules to facilitate communication, positioning, and orientation operations of the flashlight 100.

The Bluetooth® communication module 630 provided in the flashlight 100 enables the one or more flashlights 100 of the flashlight system 600 to operatively couple with a mobile computing device 680 of a user. The mobile computing device 680 can enable the user to program lighting modes of the coupled flashlight 100, as well as to operate the coupled one or more flashlights 100 in unison in accordance with one or more lighting modes stored in the mobile computing device 680. In implementation the mobile computing device 680 can have a software app to program the lighting modes of the flashlights, to store pre-programmed and programmed lighting modes, and to operate the coupled flashlights 100 in unison in accordance with a selected programmed or pre-programmed lighting mode.

Figure 7A:
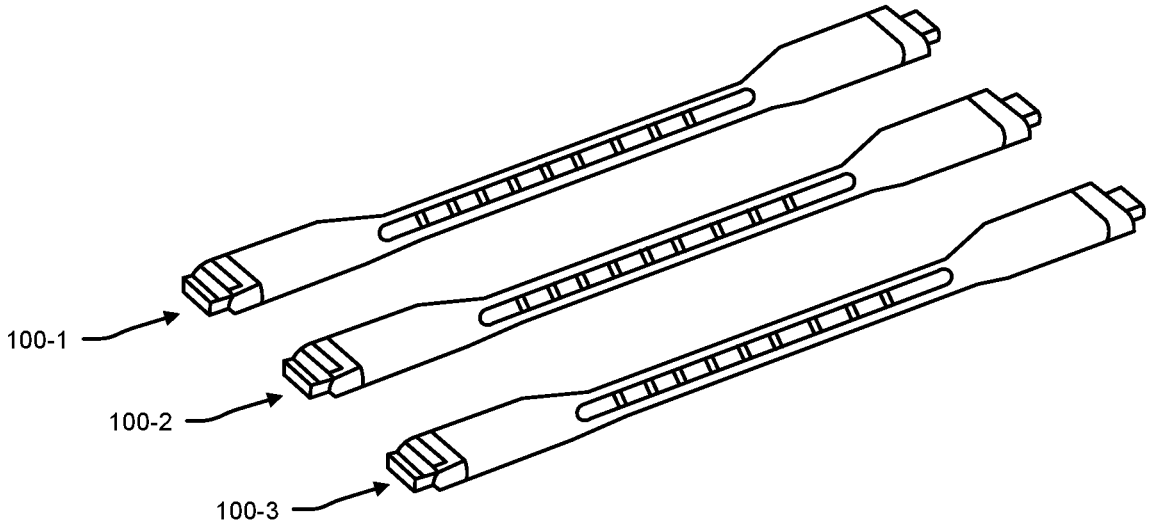
FIG. 7A shows a number of standalone flashlights in a straight configuration, each configured for emitting light of a different color, according to the embodiments herein.

FIG. 7A, with reference to FIGS. 1A through 6, shows a number of standalone flashlights 100-1, 100-2, 100-3 in straight configuration, each may be customized for emitting light of a different color to create decorative effect. In an example, the standalone flashlights 100-1, 100-2, 100-3 may be positioned with a uniform spacing therebetween or may have a non-uniform spacing therebetween. Moreover, the standalone flashlights 100-1, 100-2, 100-3 may have a uniform lighting effect/color or a non-uniform lighting effect/color. Additionally, the lighting effects/colors of the standalone flashlights 100-1, 100-2, 100-3 may be sequentially timed to create a strobed effect, according to another example.

Figure 7B:
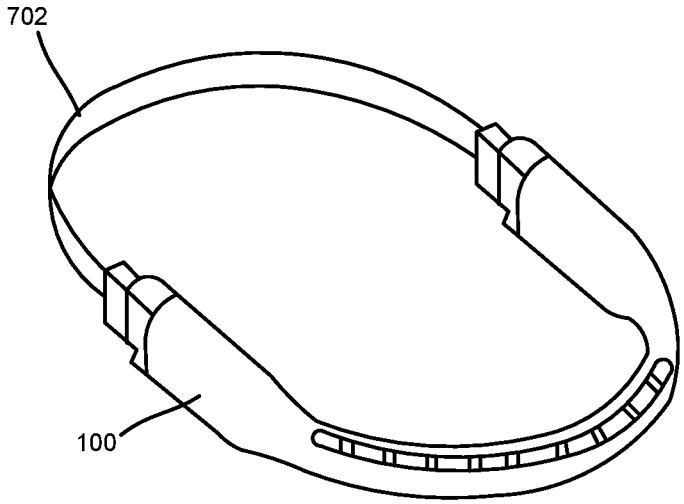
FIG. 7B shows a flashlight customized for wearing on the head or arm of a user by coupling to an adjustable strap, according to the embodiments herein.

FIG. 7B, with reference to FIGS. 1A through 7A, shows a flashlight 100 customized for wearing on head, arm, leg, neck, waist, etc. of a user by coupling to an adjustable strap 702, according to the embodiments herein. The flashlight 100 can be customized to this shape by bending the middle portion 102 and coupling the hinged male and female interlocking pieces 108 and 110 respectively with a female end and a male end of the adjustable strap 702.

Figure 7C:
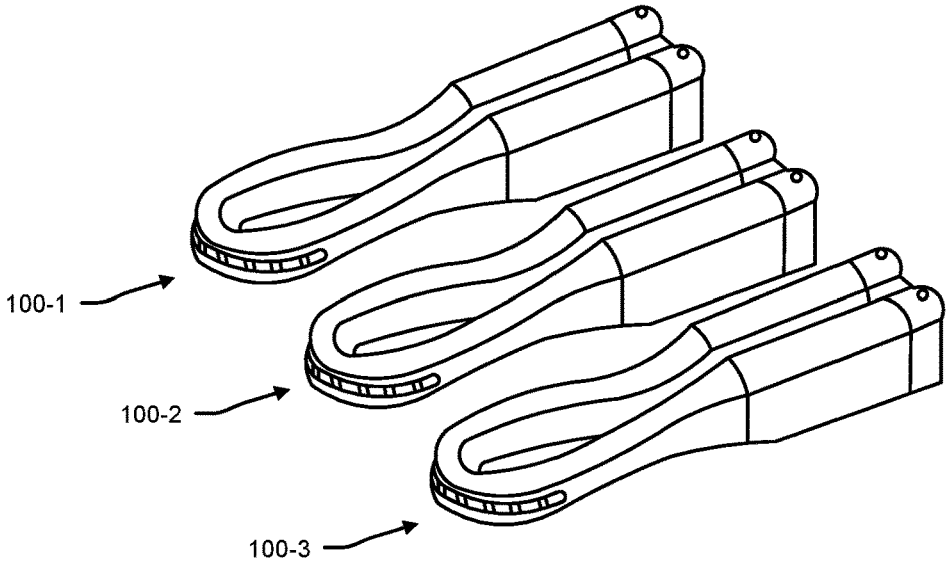
FIG. 7C shows flashlights customized for use in a handheld device mode by bringing the male and female hinged clasps in parallel disposition and interlocking the corresponding hinged male and female interlocking pieces, according to the embodiments herein.

FIG. 7C, with reference to FIGS. 1A through 7B, shows flashlights 100-1, 100-2, 100-3 customized for use in handheld device mode by bringing the male and female hinged clasps 104 and 106 in parallel disposition and interlocking the corresponding hinged male and female interlocking pieces 108 and 110 with each other after they are rotated about the respective hinge axes A-A and B-B to face each other.

Figure 7D:
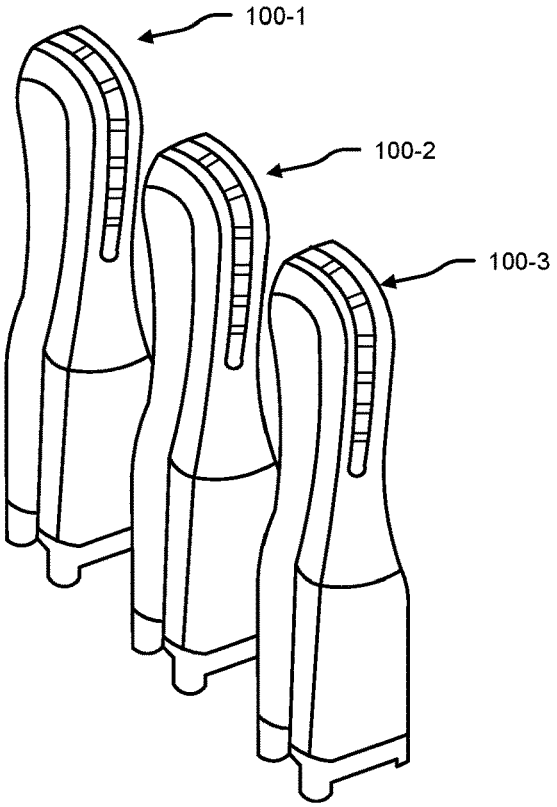
FIG. 7D shows the customized flashlights of FIG. 7C being used in a lantern mode by placing on a flat surface in a vertical orientation, according to the embodiments herein.

FIG. 7D, with reference to FIGS. 1A through 7C, shows the customized flashlights 100-1, 100-2, 100-3 of FIG. 7C being used in a lantern mode by placing on a flat surface in vertical orientation. The magnet components 214, by providing the attractive force, may help the first end 114 and the second end 116 to remain together. Furthermore, the magnet components 214 may also keep the customized flashlights 100 stable by providing a stabilizing magnetic force, if placed on a metallic surface.

Figure 8A:
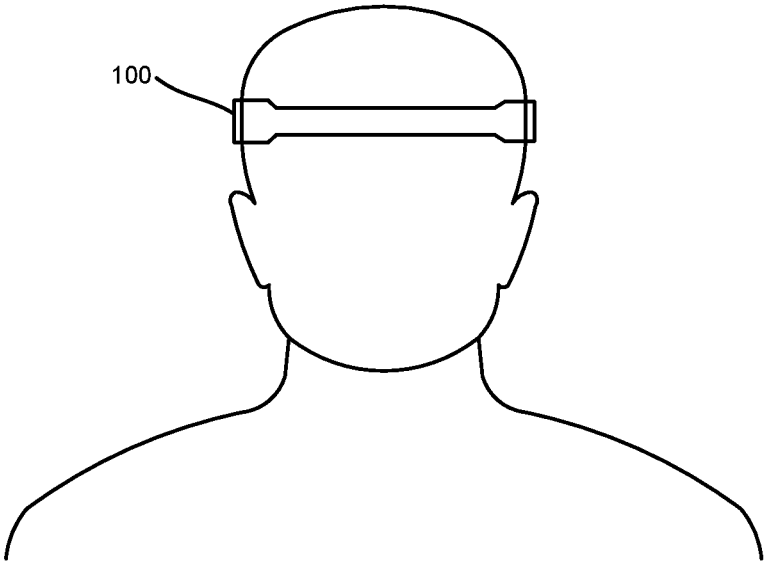
FIG. 8A shows the customized flashlights of FIG. 7B worn on the head of a user, according to the embodiments herein.

FIG. 8A, with reference to FIGS. 1A through 7D, shows the customized flashlights 100 of FIG. 7B worn on head of a user. The adjustable strap 702 helps to adjust the size to suite individual users or also in wearing as an arm band. Additionally, the adjustable strap 702 can be adjusted to accommodate other areas of a user such as the legs, ankles waist, or neck, etc.

Figure 8B:
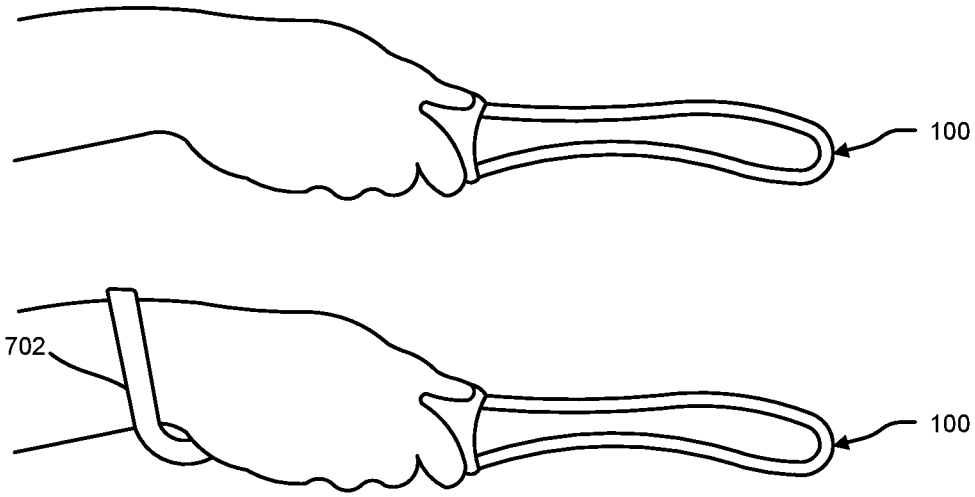
FIG. 8B shows the customized flashlights of FIG. 7C being used as a handheld device without and with a strap, according to the embodiments herein.

FIG. 8B, with reference to FIGS. 1A through 8A, shows the customized flashlights 100 of FIG. 7C being used as a handheld device without and with the adjustable strap 702. The adjustable strap 702 may be removable from the flashlights 100. Moreover, in this configuration, the adjustable strap 702 may be used to ensure the flashlight 100 remains attached to the user by the strap 702 in case the user releases the flashlight 100 from the user's hand or the flashlight 100 becomes dislodged from the user's hand.

Figure 8C:
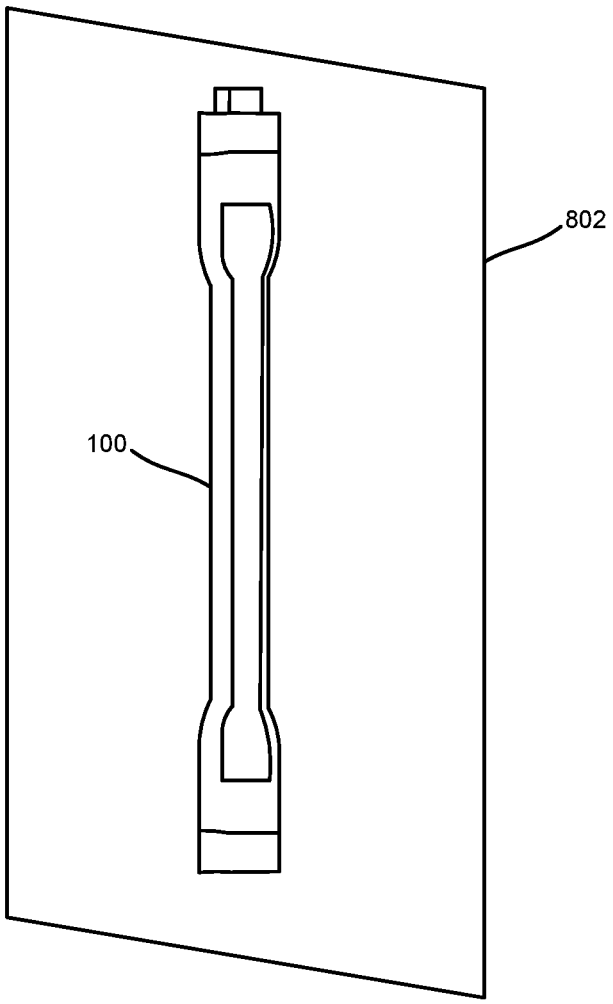
FIG. 8C shows a standalone flashlight in straight configuration coupled to a vertical metallic surface, according to the embodiments herein.

FIG. 8C, with reference to FIGS. 1A through 8B, shows a standalone flashlight 100 in a straight configuration coupled to a vertical metallic surface 802. The magnet components 214 retain the flashlight 100 fixed to the vertical metallic surface 802 by providing a magnetic force. In this configuration, a user does not have to hold the flashlight 100 in order for the flashlight 100 to be positioned. Moreover, in areas where there is an uneven ground or surface that would ordinarily compromise the positioning of the flashlight 100, the retention of the flashlight 100 to the vertical metallic surface 802 may aid in retaining the flashlight 100 in a desired position.

Figure 8D:
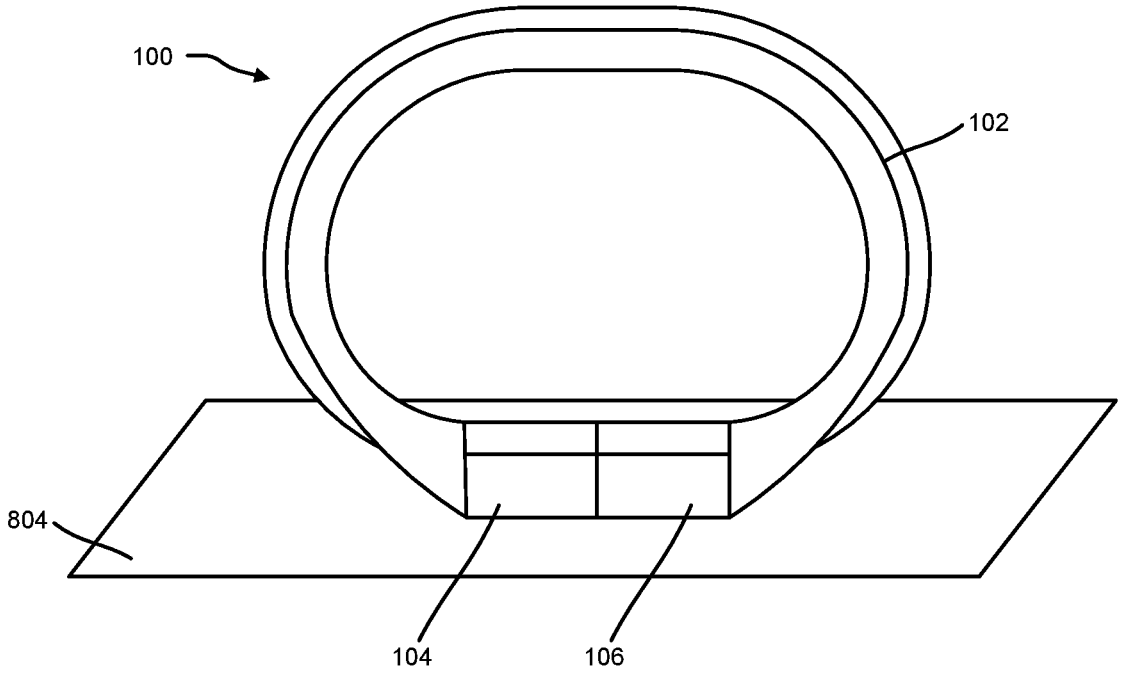
FIG. 8D shows use of a flashlight in a mood light mode by bending the middle portion to a circular shape and interlocking the hinged male interlocking piece and the hinged female interlocking piece to each other without rotation, according to the embodiments herein.
Figure 8E:
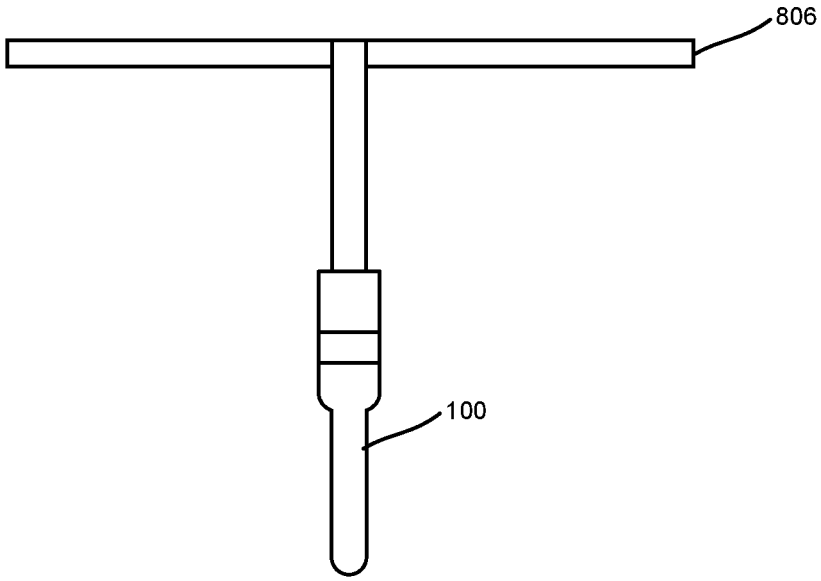
FIG. 8E shows use of a flashlight hung from a bar using the adjustable strap, according to the embodiments herein.

FIG. 8D, with reference to FIGS. 1A through 8C, shows use of a flashlight 100 in mood light mode. The example shape shown therein is obtained by bending the middle portion 102 to bring the hinged male and female interlocking pieces 108 and 110 in a facing disposition and interlocking the corresponding hinged male and female interlocking pieces 108 and 110 with each other without rotating them, thereby creating a circular shape. The flashlight 100 in this shape can be placed on a flat surface 804 by resting the interlocked male and hinged female interlocking pieces 108 and 110 on the surface 804. Moreover, other suitable shape configurations are possible in accordance with the embodiments herein by bending the middle portion 102 according to a desired shape or configuration. FIG. 8E, with reference to FIGS. 1A through 8D, shows use of a flashlight 100 hung from a bar 806 using the adjustable strap, such as strap 702 shown in FIG. 7B. In an example, in this configuration, the flashlight 100 could also be hung from an apparatus such as a carabiner or other type of equipment.

It is to be appreciated that, while the examples described herein and illustrated in the drawings show some of the shapes and modes of use for of the flashlight 100, making use of flexible nature of the flashlight and features of the hinged male and female interlocking pieces 108 and 110, it is possible to configure numerous shapes and forms by combining, such as in series, one or more flashlights, such as flashlights 100-1, 100-2, 100-3, and one or more adjustable straps 702, and coupling the one or more flashlights 100 to a mobile computing device, such as the mobile computing device 680 shown in FIG. 6, to operate the coupled one or more flashlights 100 in different programmed or pre-programmed lighting modes, or in unison in accordance with one of the programmed or pre-programmed lighting modes.

Thus, the embodiments herein provide a modular, customizable and flexible flashlight 100, and a flashlight system 600 that contains one or more of the modular, customizable, and flexible flashlights 100. The flexible flashlight 100 can be bent and its two ends interlocked, either with each other or with a corresponding end of another flashlight 100 or an adjustable strap 702, to customize a single flashlight 100 or one or more flashlights 100 in different shapes for use in different modes.

The Bluetooth® communication module 630 provided in the flashlight 100 allows the flashlight 100 to be operatively coupled to a mobile computing device 680 of a user. An app in the coupled mobile computing device 680 may allow the user to program the one or more flashlights 100 for customized lighting modes. The Bluetooth® communication module 630 of the flashlight 100 also enables coupling of a number of flashlights 100-1, 100-2, 100-3 to a user's mobile computing device 680 to create a flashlight system 600 that works in unison in different programmed and pre-programmed lighting modes.

The embodiments herein provide a portable, wearable, and waterproof flashlight 100 that can be held in the hand of a user, worn on by a user, and hung and/or positioned on different surfaces and equipment. The embodiments herein may be used in various modes and for various applications. For example, the flashlight 100 and flashlight system 600 may be provide a user to handle the flashlight 100, without necessarily requiring the user to hold the flashlight 100 in the user's hands, in any of the following non-limiting situations: camping, hiking, trekking, rock climbing, surfing, swimming, scuba diving, cycling, jogging, and spelunking, among many other sporting or leisure situations and uses.

The foregoing description of the specific embodiments will so fully reveal the general nature of the embodiments herein that others may, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein may be practiced with modification within the spirit and scope of the appended claims.

What is claimed is:

1. A flashlight comprising:

a longitudinal elongated middle portion having an array of light emitting diodes (LEDs) arranged for emitting light from a front side of the middle portion, the middle portion being flexible, wherein the flexibility enables bending of the middle portion in a plane through a longitudinal axis of the flashlight;

a male hinged clasp configured on a first end of the middle portion, the male hinged clasp having a hinged male interlocking piece for rotary movement about a corresponding hinge axis perpendicular to a plane of bending of the middle portion; and a female hinged clasp configured on a second end of the middle portion, the female hinged clasp having a hinged female interlocking piece for rotary movement about a corresponding hinge axis perpendicular to the plane of bending of the middle portion, the hinged female interlocking piece being configured to interlock with the hinged male interlocking piece.

2. The flashlight of claim 1, wherein, in a first mode of application, the first end and the second end are brought together such that the male hinged clasp and the female hinged clasp are in a substantially parallel disposition with the hinged male interlocking piece and the hinged female interlocking piece rotated and interlocked to each other, wherein, in a second mode of application, the middle portion is bent to a substantially semi-circular shape and the hinged male interlocking piece and the hinged female interlocking piece are respectively interlocked with a female end and a male end of an adjustable strap, and wherein, in a third mode of application, the middle portion is bent to a substantially circular shape and the hinged male interlocking piece and the hinged female interlocking piece are interlocked to each other without rotation the male and hinged female interlocking pieces.

3. The flashlight of claim 1, wherein the middle portion comprises:

a front cover;

a back cover;

a set of first side covers comprising a front first side cover and a back first side cover; and a set of second side covers comprising a front second side cover and a back second side cover, wherein the front cover, the back cover, the set of first side covers, and the set of second side covers are coupled to each other.

4. The flashlight of claim 1, comprising one or more capacitive touch pads located on a flexible transparent board attached to the front cover, wherein the flexible transparent board is attached with the capacitive touch pads allowing transmission of the emitted light from the array of LEDs, and allowing control of an intensity of the emitted light by switching individual LEDs on and off.

5. The flashlight of claim 3, comprising a pair of magnet components located at the first end and the second end of the middle portion within the set of first side covers and the set of second side covers, wherein the magnet components are configured such that the male hinged clasp and the female hinged clasp, when interlocked, remain coupled to each other under attractive force of the magnet components.

6. The flashlight of claim 1, comprising a controller, wherein the array of LEDs includes red, green, blue+white (RGBW) LEDs, and wherein the controller controls the RGBW LEDs to operate the flashlight in different lighting modes.

7. The flashlight of claim 6, wherein the control of the RGBW LEDs by the controller to generate different lighting modes includes activating one or more selected sets of RGBW LEDs to emit light of different colors, activating one or more selected sets of RGBW LEDs at any of full intensity or partial intensity.

8. The flashlight of claim 6, comprising a storage operatively coupled to the controller, wherein the storage is configured to store different lighting modes comprising programmed and pre-programmed lighting modes.

9. The flashlight of claim 6, comprising a set of buttons comprising one or more of:

a mode/sleep button that toggles (i) between the different pre-programmed and programmed lighting modes, and (ii) between a sleep mode and active mode of operation; and a color button to toggle through different colors emitted by the LEDs in the selected lighting mode, wherein the color button is selectively engaged to indicate a power level of the flashlight.

10. The flashlight of claim 1, comprising a power module for powering the LEDs, wherein the power module having one or more rechargeable batteries and a charging port.

11. The flashlight of claim 1, comprising one or more of a Global System for Mobile (GSM) Communications module, a Global Positioning System (GPS) module, and an Electronic Compass (EC) module.

12. A flashlight system comprising:

one or more flashlights, each of the flashlights comprising:

a longitudinal elongated middle portion having an array of light emitting diodes (LEDs) arranged for emitting light from a front side of the middle portion, the middle portion being flexible, wherein the flexibility enables bending of the middle portion in a plane through a longitudinal axis of the flashlight;

a male hinged clasp configured on a first end of the middle portion, the male hinged clasp having a hinged male interlocking piece for rotary movement about a corresponding hinge axis perpendicular to a plane of bending of the middle portion; and a female hinged clasp configured on a second end of the middle portion, the female hinged clasp having a hinged female interlocking piece for rotary movement about a corresponding hinge axis perpendicular to the plane of bending of the middle portion, the hinged female interlocking piece being configured to interlock with the hinged male interlocking piece;

wherein the hinged male and female interlocking pieces allow the one or more flashlights to be customized in different shapes and to couple operation of the one or more flashlights together, wherein each of the one or more flashlights comprises a communication module configured to operatively couple to a mobile device running an app to program the one or more flashlights for operation in different lighting modes, and wherein the app is further configured to operatively couple to and operate the one or more flashlights in unison.

13. The flashlight system of claim 12, wherein the different shapes of the one or more flashlight comprise any of:

a circular shape created by bending the middle portion to a circular shape and interlocking the hinged male interlocking piece and the hinged female interlocking piece to each other without rotation of the hinged male and female interlocking pieces;

a lantern shape created by bringing the first end and the second end together in parallel disposition, rotating the hinged male and female interlocking pieces and interlocking the hinged male and female interlocking pieces to each other; and a semi-circular shape created by bending the middle portion and coupling the hinged female and male interlocking pieces respectively with a female end and a male end of an adjustable strap.

14. The flashlight system of claim 12, wherein the middle portion comprises:

a front cover;

a back cover;

a set of first side covers comprising a front first side cover and a back first side cover; and a set of second side covers comprising a front second side cover and a back second side cover, wherein the front cover, the back cover, the set of first side covers, and the set of second side covers are coupled to each other.

15. The flashlight system of claim 14, wherein each of the one or more flashlights comprises one or more capacitive touch pads located on a flexible transparent board attached to the front cover, and wherein the flexible transparent board is attached to the front cover with the one or more capacitive pads to allow a transmission of the emitted light from the array of LEDs, and allowing control of an intensity of the emitted light by switching individual LEDs on and off.

16. The flashlight system of claim 14, wherein each of the one or more flashlights comprises a pair of magnet components located at the first end and the second end of the middle portion within the a set of first side covers and the a set of second side covers, and wherein the magnet components are configured such that the male hinged clasp and the female hinged clasp, when interlocked, remain coupled to each other under attractive force of the magnet components.

17. The flashlight system of claim 12, wherein the array of LEDs includes red, green, blue+white (RGBW) LEDs, and wherein the controller controls the RGBW LEDs to operate the flashlight in different lighting modes.

18. The flashlight system of claim 17, wherein the control of the RGBW LEDs by the controller to generate different lighting modes includes activating one or more selected sets of RGBW LEDs to emit light of different colors, activating one or more selected sets of RGBW LEDs at any of full intensity or partial intensity.

19. The flashlight system of claim 17, wherein each of the one or more flashlights comprises a storage operatively coupled to the controller, and wherein the storage is configured to store different lighting modes comprising preprogrammed and programmed lighting modes.

20. The flashlight system of claim 12, wherein each of the one or more flashlights comprises a power module for powering the LEDs, and wherein the power module having one or more rechargeable batteries and a charging port.

* * * * *